US005692686A

United States Patent [19]

Moreau

[11] Patent Number: 5,692,686

[45] Date of Patent: Dec. 2, 1997

[54] CHOPPER FAN FOR A FRAGMENTATION MACHINE FOR RECYCLING ITEMS MADE OF PLASTICS MATERIAL

[76] Inventor: Pierre Moreau, 35 a, rue de Verdun, 57600 Forbach, France

[21] Appl. No.: 625,122

[22] Filed: Apr. 1, 1996

[30] Foreign Application Priority Data

Apr. 7, 1995 [FR] France ..... 95 04151

[51] Int. Cl.[6] ..... B02C 15/16

[52] U.S. Cl. ..... 241/56; 241/60; 241/165.5; 241/277

[58] Field of Search ..... 241/56, 60, 277, 241/165.5

[56] References Cited

U.S. PATENT DOCUMENTS

| | | | |
|---|---|---|---|
| 1,875,514 | 9/1932 | Soileau | 241/56 X |
| 3,164,330 | 1/1965 | Neidl | 241/165.5 |
| 5,018,672 | 5/1991 | Peck et al. | 241/56 X |

FOREIGN PATENT DOCUMENTS

| | | | |
|---|---|---|---|
| 509350 | 3/1952 | Belgium | 241/56 |
| 934852 | 11/1955 | Germany | 241/56 |
| 426156 | 10/1947 | Italy | 241/56 |

*Primary Examiner*—Mark Rosenbaum

[57] ABSTRACT

A chopper fan for destroying and then recycling items formed of plastic material. The fan includes saw blades and a toothed disk downstream of the saw blades.

10 Claims, 4 Drawing Sheets

CHOPPER FAN FOR A FRAGMENTATION MACHINE FOR RECYCLING ITEMS MADE OF PLASTICS MATERIAL

The present invention relates to a chopper fan for a fragmentation machine conveying small pieces of plastics material in a flow of air of a machine, for destroying and then recycling items made of plastics material, and in particular, but not exclusively, rolls of thermoforming scrap. Such a machine can also shred plastics items such as empty receptacles, bottles, or the like.

BACKGROUND OF THE INVENTION

Such machines already exist for shredding plastics items such as thermoforming sprues. However they use powerful mechanical members that consume energy and the cost of operating such a machine is very high. A roll of thermoforming waste is in the form of a cylinder that is eight hundred millimeters in diameter and whose weight lies in the range 10 kg to 20 kg.

It is known that powder or particulate material can be sucked up by means of a rotary device having a suction duct that opens out into a suction chamber in which there rotates a set of fan blades driven by a motor, with air and the sucked-up material being expelled under pressure via an outlet duct. In known devices, a mixture of air and particles is sucked into a hopper, and it is thus possible to direct the mixture towards a final destination. Such devices operate in satisfactory manner so long as the material to be moved is sufficiently fine, or at least fairly uniform. When conveying chopped plastics materials, the pieces are not of uniform size and the biggest pieces can come into contact with the wall of the suction chamber and prevent the fan blades from rotating, thus preventing the device from operating.

OBJECTS AND SUMMARY OF THE INVENTION

The present invention seeks to mitigate the above drawbacks.

The design of the invention is such that the substance placed in the feed hopper is destroyed automatically without it being necessary for personnel to be present. The items placed in the machine are reduced in a few minutes and, by means of a preset timer, the machine stops automatically once destruction is complete, and this happens every time sprue is discharged form the thermoforming machine, thereby saving space.

The machine is comprises and inclined cylindrical drum mounted on a stand and having a bottom that is movable in alternating rotation, and at least one saw blade rotating inside the drum under drive form a motor, the diameter of the blade being equal to half the diameter of the drum.

The alternating rotary motion of the bottom of the drum can be obtained in conventional manner, either via a motor and step-down gear unit or by a rack and pinion assembly driven by a pneumatic actuator.

The saw blade is mounted to rock inside a housing included in the bottom of the drum. The blade is secured to a motor which is itself mounted to rock about a horizontal and received in its housing without biting into plastics material. The blade is thus retracted, thereby making it possible to start the machine while if is under no load. In contrast, as soon as the bottom of the drum begins to move, the blade rocks so as to become inclined relative to the bottom of the drum. It tears up any material that is to be found in a first ring on the bottom of the drum. Then, after reversing the rotary motion of the bottom of the drum, it rocks in the opposite direction relative to the bottom of the drum and tears up material to be found in a second ring thereon.

The cut-up waste is sucked out through a central tube by means of a centrifugal suction fan which sucks out the waste in sawdust-confetti form and blows it into a cyclone for separating the air form the treated waste.

An object of the present invention is to mitigate that drawback and to include a chopping chamber within the suction chamber for the purpose of reducing the size of the sucked-in pieces of plastics material.

The invention is based on the idea that it is possible to use the drive shaft for the fan blades to rotate chopping saws.

According to the invention, the chopper fan, in particular for chopping plastics materials, comprises a suction duct leading to a suction chamber within which there rotates at least one fan blade under drive from a motor, the suction chamber communicating with an outlet duct, wherein upstream from the suction chamber there is formed a chopping chamber in which there rotates at least one toothed disk, the chopping chamber communicating with the suction chamber.

The chopping chamber forms a baffle that allows air to flow through but that is suitable for retaining large-sized pieces of plastics material. Inside the chopping chamber there rotates at least one disk whose periphery constitutes a saw blade. The periphery is close to the casing of the chopping chamber.

According to another characteristic of the invention, the inside of the chopping chamber is lined with perforated sheet metal. The lining constitutes a backing that cooperates with the fan blade to enable effective chopping to take place. Thus, large pieces of plastics material cannot slide along the circular wall of the chamber, but are held in position so that the saw cuts through them until they have been reduced to the maximum acceptable size.

Other characteristics and advantages of the invention will appear from the following description of particular embodiments given purely as non-limiting examples, and with reference to the accompanying drawings, in which.

Figure 1:
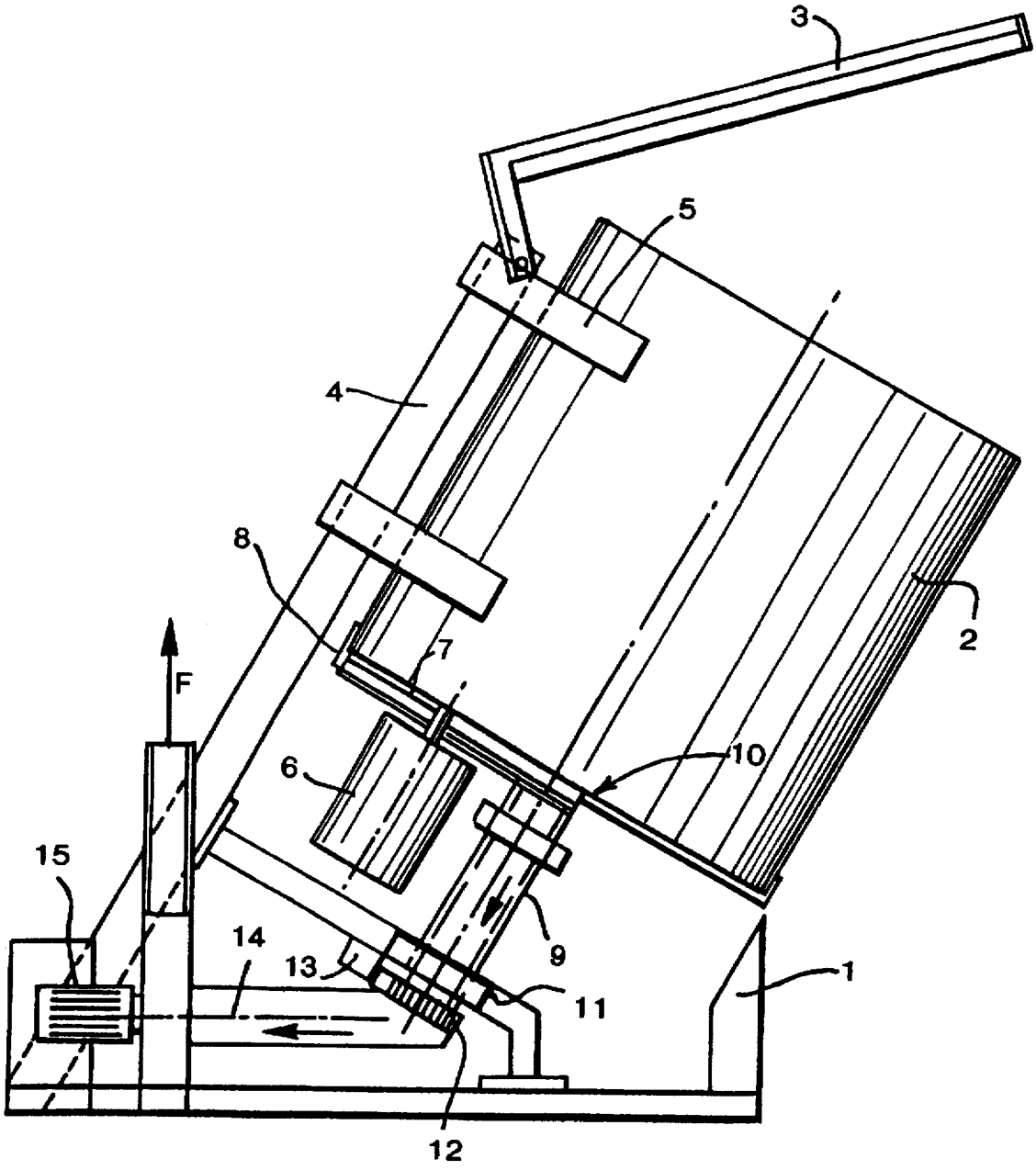
FIG. 1 is a diagrammatic view of a machine of the invention.

In FIG. 1, there can be seen a machine comprising a stand 1, itself standing on the ground. A treatment drum 2 is mounted on the stand 1 so as to be inclined at about 60° and serves to receive items of plastics material that are to be shredded or torn up. The inclination allows the items inserted into the top of the drum to move down automatically under gravity. The drum is closed by a lid 3 hinged on a side rail 4 whose other end is secured to the stand 1. The drum 2 is supported by the rail 4 via an arm 5. Beneath the drum 2 there is a motor 6 for driving a saw blade 7 all rotate with the central portion of the bottom of the drum 2 which corresponds to a duct 9 whose function is explained below.

The duct 9 is secured to the bottom 10 of the drum 2 which is mounted to pivot relative to the side wall thereof.

To this end, the duct 9 rotates in bearings 11 secured to the stand 1.

In the example shown, the duct 9 is driven with alternating motion by a toothed wheel 12 engaged in an assembly that comprises a rack driven by a pneumatic actuator 13. Any other drive means such as a motor and gear box unit, for example, could alternatively be used. The hollow duct 9 has its other end feeding a horizontal duct 14 connected to a fan 15 which, by establishing suction, sucks out the shredded material and blows it to a cyclone (not shown) or other separator device, as symbolized by arrow F, form which material that is practically in powder form can be delivered to container for transporting to a location for recycling.

Figure 2:
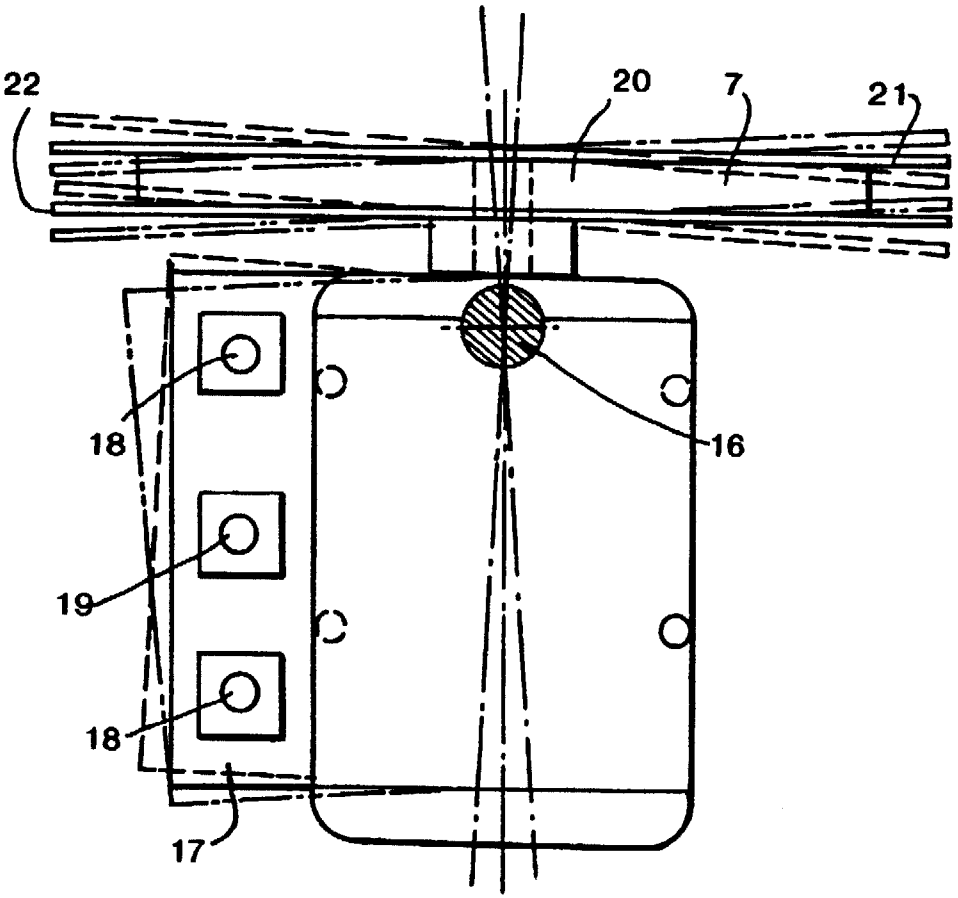
FIG. 2 is an elevation view of the shredder motor.

FIG. 2 shows how the motor 6 is mounted. The motor 6 is hinged to the stand 1 about a shaft 16. The drive shaft carries a saw blade 7 which, in accordance with the invention, is capable of taking up three positions that are adjustable as a function of the motor casing. When the casing is vertical, the blade 7 is horizontal and contained in a housing so it is inactive even if power is supplied to the motor, with plastics items generally remaining on top of the housing. This is a starting position where the motor revolves under no load. The body of the motor is secured to a plate 17. Three small pneumatic actuators 18 are formed in this plate, each having a rod that constitutes a finger (not shown) capable of penetrating in a hole in the support 17. Each finger is terminated by a conical end capable of sliding in the corresponding hole 19 so as to center the support automatically. Depending on which is selected depends on the displacement direction of the actuator, i.e. on the direction in which the moving bottom 10 is rotated, and appropriate connections are made by automatic means.

Figure 3:
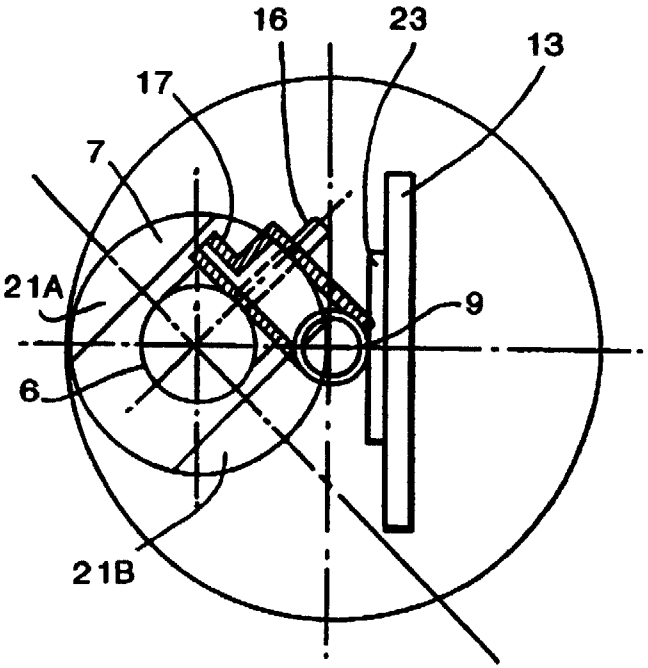
FIG. 3 is a diagram showing how the motor is mounted on the machine.

As can be seen in FIG. 2, and in FIG. 3, the saw 7 is practically constituted by a hub 2*a* carrying two circular saw blades 21 and 22 that are screwed to the hub 20. In FIG. 2, the rest position is shown in solid lines and the other two positions in broken lines.

FIG. 3 is a plan view of the motor assembly in which there can also be seen the pneumatic actuator 13 and the rack 23", the rack meshing with a toothed wheel secured to the emptying tube 9. There can also be seen the motor support 17 pivotally mounted on a shaft 16 which is free to rock relative to the stand 1, and there can also be seen the saw blades 21 and 22.

Figure 4:
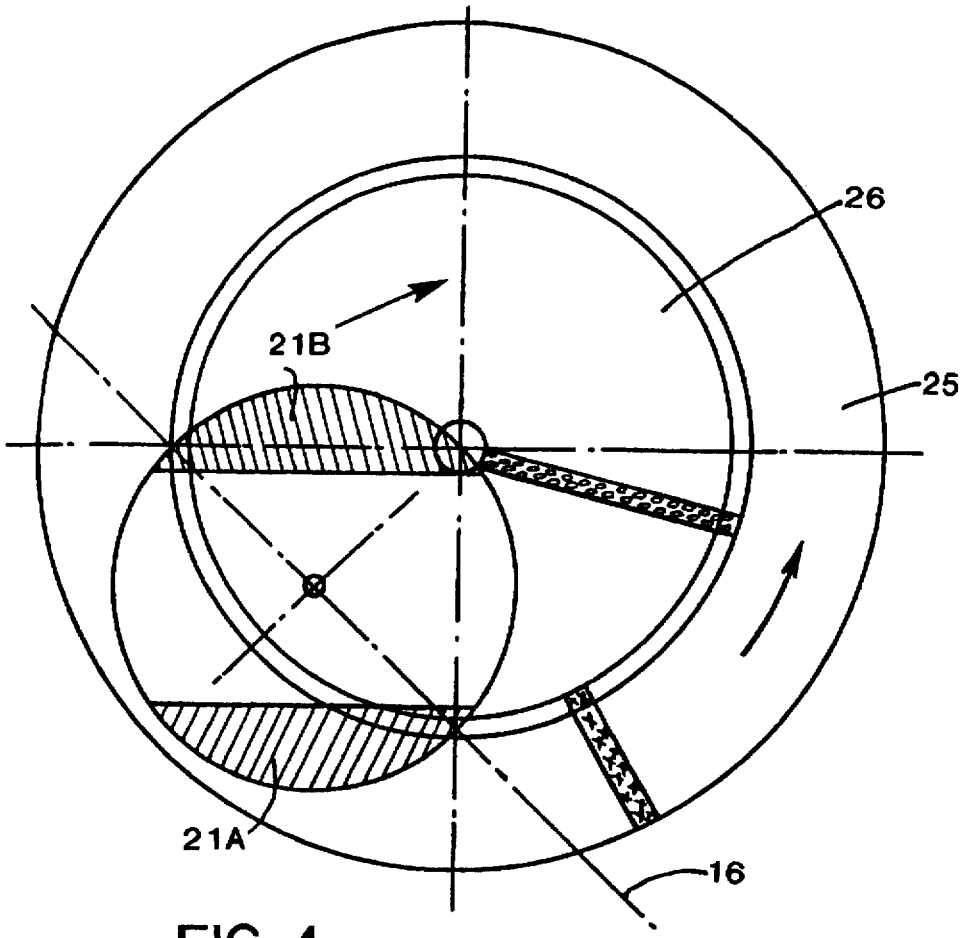
FIG. 4 is a diagram for explaining how the bottom of the drum is swept by the saw blade.

The shredding operation performed by the blades 21 and 22 is described with reference to FIG. 4 which is a geometrical diagram showing how the invention makes it possible to sweep the total surface area of the bottom 10 of the drum 2 while using a saw of a diameter that is smaller than the diameter of the bottom.

Initially, the moving bottom rotates counter clockwise. The motor is likewise rocked counterclockwise and consequently the blade 21 projects about 2 cm above its housing 8. The motor 6 rotates at about 3,000 revolutions per minute (rpm) while the bottom of the drum rotates at about 10 rpm. Under such conditions, the section 21A sweeps the outer ring 25 and reduces any material bearing against said ring to fragments.

After the bottom 10 of the drum 2 has performed a complete turn, possibly after rotating through practically 380°, the movement of the actuator 1" and of the rack 23 is reversed. The bottom then rotates in the clockwise direction. The position of the motor 6 is altered by an actuator 18 so that the sector 21A returns into the housing 8 while the sector 21B projects therefrom. As before, the motor 6 continues to rotate in the same direction and the sector 22 sweeps the inner ring 26 of the bottom of the drum and shreds the material that is to be found in this region, with the material that has been reduced to small pieces being removed via duct 9. These operations continue until all of the material in the drum has been fragmented. The time required for fragmentation is set by a timer (not shown) which is started by closing the lid 3. For safety reasons, the grinder of the invention will only operate when the lid is closed.

Once the machine has been loaded, a destruction cycle is initialized and takes place as follow:

- the lid is closed (for safety);
- the machine is switched on;
- the electric motor driving saw starts;
- the saw blade moves out by an amount defining its cutting height, which height is adjustable;
- the bottom of the drum is caused to rotate through an angle lying in the range 360° to 380°;
- the blade is retracted into its housing;
- the blade is extended by an amount that is identical, but diametrically opposite, and
- the bottom of the drum is caused to turn in the opposite direction to the preceding direction, and through an angle of 360° to 380°.

Figure 5:
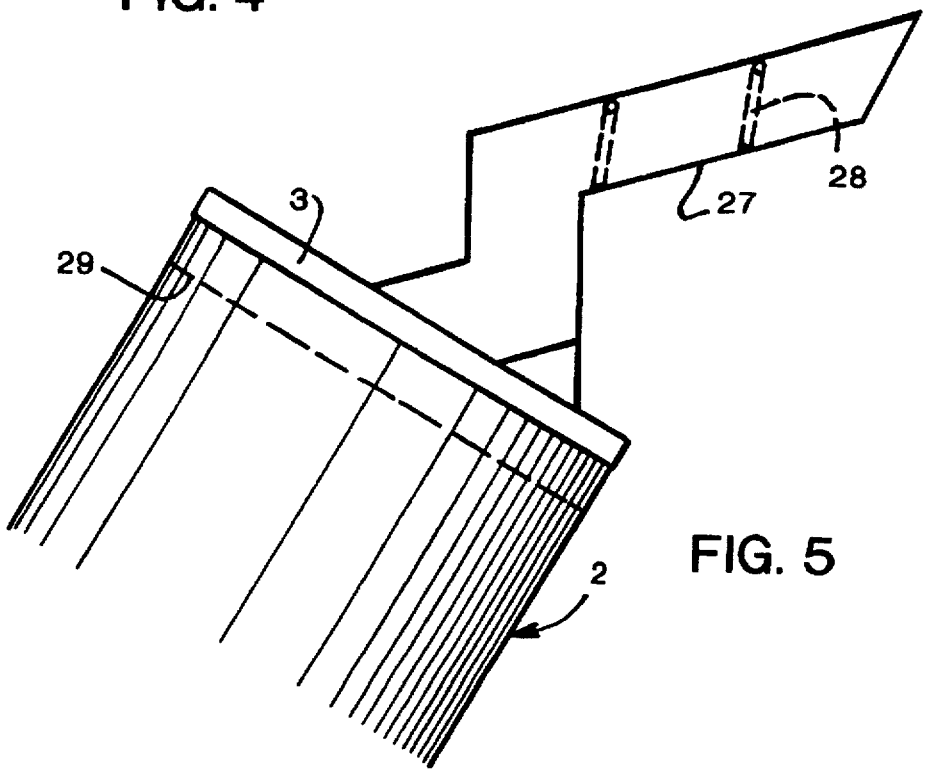
FIG. 5 shows a variant of the machine specifically designed for plastics receptacles such as bottles.

FIG. 5 shows a variant use for the machine of the invention more specifically intended for plastics receptacles such a bottles. In this case, the lid 3 of the drum 2 is closed and remains closed. It carries an insertion hopper or chute 27 enabling plastics items to be inserted of a calibre that is determined by the diameter of the chute. A sensor represented by line 29 issues a signal as soon as the drum 2 is full. The motor 6 then operates to shred the items that are to be recycled. To prevent any pieces of shredded matter escaping, the inside of inclined chute 27 is preferably provided with non-return flaps 28.

Figure 6:
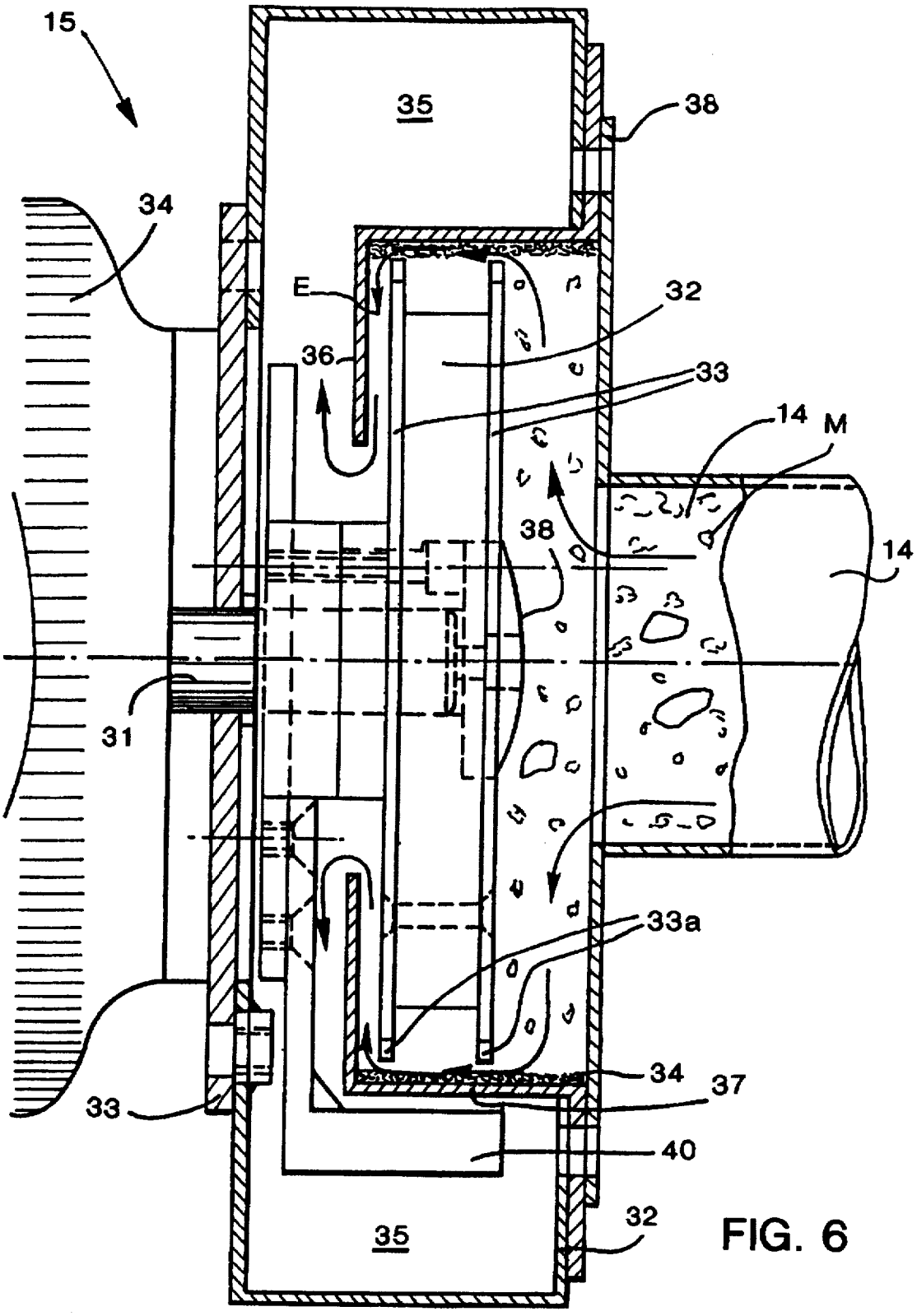
FIG. 6 is a vertical section through a chopping fan of the invention.

From right to left in FIG. 6, there can be seen a suction duct 14 mounted on a suction casing 32 that forms the suction chamber. The casing 32 is generally cylindrical in shape and it is itself mounted on the flange 33 of a motor 34. The suction duct communicates through the suction chamber 35 with an outlet duct (not shown). The assembly forms a snail-shaped structure that accelerates air flow (represented in FIG. 6 by unreferenced arrows).

Between the casing 32 and the flange 38 of the suction duct 14, there is disposed a casing or detector 37 of diameter and depth smaller than those of the chamber 35 and disposed concentrically about the inlet duct. The inside of the chopping chamber 37 communicates via an opening 39 with the inside of the suction chamber 35. A set of fan blades 40 rotates in the chamber 35, with the number of fan blades being arbitrary and only one fan blade appearing in FIG. 1. The fan blades 40 are driven by the motor shaft 31. When the fan blades are rotated at high speed, suction is established in the suction duct, thereby drawing in the air-material mixture, and pressure is caused to increase in the outlet duct which ejects matter towards the outlet. Small- or medium-sized pieces of plastics material travel normally with the air along the arrows.

One or two saw blades 33 are mounted inside the chamber 37 on a hub 32, and the ends 33*a* of the saw blades serve to chop up matter before it can pass together with the air into the suction chamber. To prevent pieces of plastics materials sliding along the wall of the casing 37 (horizontal in the figure), a perforated or ribbed sheet of metal 14 is placed there against thus constituting a kind of non-slip lining. This ensures that large pieces of plastics material are automatically cut up. After being cut up they are sucked between the edge 36 of the casing 37 and the inner saw blade. The size of the gap E determines the maximum size of pieces of plastics material that can be accepted for subsequent removal. The hub 32 is mounted on the drive shaft 31, for example, by means of a retaining key, and the front of the assembly is closed by a circular plug 38.

Operation of the chopper fan is as follows:

Once the motor is in operation, suction is established in the suction duct and pieces M are sucked in the direction indicated by the arrows. The chopping chamber 37 constitutes a baffle that obliges the pieces of material to pass round the outside of the teeth of the saw 33. Small pieces pass through without difficulty and enter the chamber 35 from which they are expelled. However, bigger pieces, on coming into contact with the disks 33, are directed by centrifugal force towards the perforated metal sheet 34. They are thus brought into contact with the saw teeth 33*a* and they are chopped up.

It will be observed that in all cases air continues to pass through while chopping is taking place. After being chopped up, the small-sized particles are capable of passing between the inner saw blade 33 and the wall 36 and then of penetrating into the suction chamber 35 from which they are expelled to the outside.

Naturally, numerous variants can be provided without going beyond the ambit of the invention, in particular by substituting equivalent technical means.

I claim:

1. A machine for fragmenting items of plastic material, comprising a stand supporting a cylindrical drum having a bottom that is movable in alternating rotation, at least one saw with a saw blade rotatably mounted inside the drum and being driven by a motor, the saw blade being of a diameter that is equal to half the diameter of the drum, wherein a chopping fan comprising a suction duct communicating with a suction chamber in which at least one fan blade is caused to rotate under drive from a fan motor, the suction chamber communicating with an outlet duct, wherein a chopping chamber is formed downstream of the suction duct, in which there rotates at least one toothed disk driven by the fan motor with the downstream end of the chopping chamber communicating with the suction chamber.

2. A machine for fragmenting items of plastic material according to claim 1 wherein, the chopping chamber has an inside wall which is lined in at least one of perforated or ribbed metal sheet for preventing large pieces of plastics material from moving.

3. A machine according to claim 1 wherein the lid is provided with a hopper for insertion of items, and with a sensor indicating when the drum is full.

4. A machine according to claim 1 wherein the at least one saw is mounted in a housing formed in the bottom of the drum, the blade being mounted on the shaft of one motor which is itself mounted to rock about an horizontal axis.

5. A machine according to claim 1 wherein the at least one saw comprises a hub having two circular saw blades screwed on opposite sides thereof.

6. A machine according to claim 1 wherein the bottom of the drum is driven in alternating rotation by a pneumatic actuator secured to a rack meshing with a toothed wheel that is secured to an hollow duct.

7. A machine according to claim 1 wherein the drive motor for the at least one saw is rocked relative to the horizontal by means of small actuators whose rods penetrate into orifices in the motor support.

8. A machine according to claim 1 wherein the blades project in alternation above the housing as a function of the direction of rotation of the moving bottom.

9. A machine according to claim 1 wherein the lid sets the machine into operation on being closed.

10. A machine for fragmenting items of plastic material comprising a stand supporting a cylindrical drum having a bottom that is movable in alternating rotation, at least one saw with a saw blade rotatably mounted inside the drum and being driven by a motor, the saw blade being of a diameter that is equal to half the diameter of the drum, wherein a chopping fan comprising a suction duct communicating with a suction chamber in which at least one fan blade is caused to rotate under drive from a fan motor, the suction chamber communicating with an outlet duct, a chopping chamber being formed downstream of the suction duct, in which there rotates at least one toothed disk driven by the fan motor.

* * * * *